US012553006B2

(12) United States Patent
Forbus, Jr. et al.

(10) Patent No.: US 12,553,006 B2
(45) Date of Patent: Feb. 17, 2026

(54) DIESTERS OF POLYETHYLENE OXIDE AS LUBRICANT BASE OILS

(71) Applicant: Vantage Santolubes Research, LLC, New Hope, PA (US)

(72) Inventors: Thomas Reginald Forbus, Jr., Spartanburg, SC (US); Salvatore Michael Perna, Greer, SC (US)

(73) Assignee: Vantage Santolubes Research, LLC, New Hope, PA (US)

( * ) Notice: Subject to any disclaimer, the term of this patent is extended or adjusted under 35 U.S.C. 154(b) by 0 days.

(21) Appl. No.: 18/726,720

(22) PCT Filed: Jan. 6, 2023

(86) PCT No.: PCT/US2023/060244

§ 371 (c)(1),
(2) Date: Jul. 3, 2024

(87) PCT Pub. No.: WO2023/133514

PCT Pub. Date: Jul. 13, 2023

(65) Prior Publication Data

US 2025/0084338 A1 Mar. 13, 2025

Related U.S. Application Data

(60) Provisional application No. 63/266,475, filed on Jan. 6, 2022.

(51) Int. Cl.
*C10M 145/38* (2006.01)
*C10M 109/00* (2006.01)
(Continued)

(52) U.S. Cl.
CPC ..... *C10M 145/38* (2013.01); *C10M 109/00* (2013.01); *C10M 2209/109* (2013.01);
(Continued)

(58) Field of Classification Search
CPC ..... C10M 145/38; C10M 109/00; C10M 2209/109; C10M 2209/1045;
(Continued)

(56) References Cited

U.S. PATENT DOCUMENTS 8,304,374 B2 * 11/2012 Brown ..... C10M 129/72 508/363
8,399,697 B2 3/2013 Weber et al.
(Continued)

FOREIGN PATENT DOCUMENTS

| | | | |
|---|---|---|---|
| GB | 1 091 457 | A | 11/1967 |
| WO | 2011161908 | A1 | 12/2011 |
| WO | 2022/150254 | A1 | 7/2022 |

OTHER PUBLICATIONS

International Search Report and Written Opinion issued in priority WO Serial No. PCT/US23/60244 on Apr. 12, 2023.
(Continued)

*Primary Examiner* — Ellen M Mcavoy
(74) *Attorney, Agent, or Firm* — Husch Blackwell LLP

(57) ABSTRACT

A lubricant fluid comprising a base oil, which utilizes carboxylic esters of carboxyl di-end-capped-polyethylene glycols, or a mixture thereof, to have ultra-low viscosity, high flash point, high viscosity index (VI), excellent low temperature properties (viscosity and pour/freeze points), and low elastohydrodynamic (EHD) shear strength, and to enable the production of high efficiency fluids with enhanced temperature properties for machines or machine elements that operate in the elastohydrodynamic regime of lubrication.

20 Claims, 4 Drawing Sheets

(51) Int. Cl.

| | |
|---|---|
| *C10N 20/04* | (2006.01) |
| *C10N 30/02* | (2006.01) |
| *C10N 30/08* | (2006.01) |
| *C10N 40/04* | (2006.01) |

(52) U.S. Cl.
CPC ..... *C10N 2020/04* (2013.01); *C10N 2030/02* (2013.01); *C10N 2030/08* (2013.01); *C10N 2040/04* (2013.01)

(58) Field of Classification Search
CPC ..... C10N 2030/02; C10N 2030/08; C10N 2040/04; C10N 2030/06
USPC ..... 508/465
See application file for complete search history.

(56) References Cited

U.S. PATENT DOCUMENTS

| | | | | |
|---|---|---|---|---|
| 8,906,836 | B2 * | 12/2014 | Jung | C10M 105/36 508/499 |
| 2012/0190883 | A1 | 7/2012 | Frey | |
| 2015/0247104 | A1 * | 9/2015 | Brekan | C10M 169/042 508/496 |
| 2017/0107440 | A1 | 4/2017 | Cuff et al. | |
| 2017/0145336 | A1 | 5/2017 | Forbus, Jr. | |
| 2017/0335231 | A1 | 11/2017 | Aoki et al. | |
| 2019/0002790 | A1 * | 1/2019 | Sanson | C10M 129/78 |
| 2022/0213400 | A1 * | 7/2022 | Forbus, Jr. | C10M 105/38 |

OTHER PUBLICATIONS

Extended European Search Report issued on Nov. 10, 2025 in European Application No. 23737790.8.

* cited by examiner

DIESTERS OF POLYETHYLENE OXIDE AS LUBRICANT BASE OILS

CROSS-REFERENCE OF RELATED APPLICATIONS

This application is a U.S. National Phase Application of International Application No. PCT/US2023/060244 filed Jan. 6, 2023, which is a continuation of and claims priority to U.S. Patent Application No. 63/266,475, filed on Jan. 6, 2022, and entitled "Diesters of Polyethylene Oxide as Lubricant Base Oils," both of which are incorporated herein in their entireties.

TECHNICAL FIELD

The present teachings relate generally to lubricating fluids, and more specifically to a lubricating base oil technology suite having ultra-low viscosity while maintaining high flash point, retaining high viscosity index (VI), excellent low temperature performance and maintaining low elastohydrodynamic (EHD) shear strength.

BACKGROUND

Elastohydrodynamic machine elements are mechanical devices that operate with a thin film of fluid between nominally smooth, rolling-sliding, elastically-deformed, non-conforming surfaces in mutual contact. Fluids in the elastohydrodynamic contact typically behave not as a viscous fluid, but as an elastic-plastic solid with a yield or shear strength to the normal rolling-shearing motion. Shearing within the contact only occurs when the two surfaces in contact have a differential in their relative speeds which can be caused by the geometry of the contact surfaces and their relative motion in the natural operation of machine elements.

The efficiency of these machine elements relies in large part upon the high-stress shear strength of the fluid used for lubricating the surfaces of these high-stress, elastically-deformed, non-conforming contacts. The shear strength properties of the fluid under the contact operational conditions can substantially influence their efficiency depending upon the degree of sliding motion between the mating surfaces under elastohydrodynamic conditions of lubrication. Thus, fluids with low elastohydrodynamic shear strength enable better efficiency with lower fluid shearing losses in the rolling-sliding or pure sliding motion in these contacts.

U.S. Pat. No. 9,879,198 describes low shear strength lubricating fluids composed of mixtures of carboxyl diester polytetramethylene ether glycols and closely related complex esters. Despite the low elastohydrodynamic shear strength of the lubricating fluids, they suffer from poor low temperature performance (e.g., pour point, freeze point), which limits applications where the fluids will be exposed to temperatures below −7° C. The contents of U.S. Pat. No. 9,879,198 are incorporated by reference herein in their entirety.

The existing lubricant fluids also suffer problems when exposed to large variations in temperature which may affect the lubricant life of the fluids or gear box life. The lubricant fluids should also be less flammable/combustible for reduced fire hazardousness.

Thus, there exists a need for improved lubricating fluids that address the above problems.

SUMMARY

The needs set forth herein as well as further and other needs and advantages are addressed by the present embodiments, which illustrate solutions and advantages described below.

It is an object of the present teachings to provide base oils for lubricants to have ultra-low viscosity, high flash point, high viscosity index (VI) while maintaining low elastohydrodynamic (EHD) shear strength and excellent low temperature performance.

It is another object of the present teachings to provide base oils for lubricants to enable lubrication with increased energy efficiency in all applications where machine elements may operate in various temperature environments (e.g., automotive, wind turbines, alternative energy), including low operating temperatures, high operating temperatures, and a broad range of operating temperatures.

It is a further object of the present teachings to provide the production of high efficiency fluids with enhanced temperature properties for machines or machine elements that operate in the elastohydrodynamic regime in lubrication.

It is a further object of the present teachings to provide base oil technologies to support the continued growth of alternative energy, particularly, in the electric vehicles (EVs) sector. Since EV transmission fluids must simultaneously act as coolants and lubricants, fluids properly formulated according to the present teachings provide increased energy efficiency and prolonged gear box life over a broad range of operating temperatures.

These and other objects of the present teachings are achieved by providing a lubricating fluid comprising a carboxyl di-ester of polyethylene glycol having the formula:

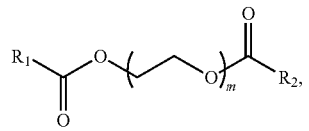

(1)

wherein R1 and R2 each independently comprise alkyl groups each having 4 to 6 carbon atoms, wherein m ranges from 2 to 12, and wherein the carboxyl di-ester of polyethylene glycol having the formula (1) has an average molecular weight ranging from 240 g/mol to 500 g/mol. R1 and R2 may each independently comprise linear alkyl groups, although not limited thereto. In an alternative embodiment, R1 and R2 each may each independently comprise branched alkyl groups. The lubricating fluid further comprises at least one additive selected from the group consisting of: oxidation inhibitors, metallic dispersants, non-metallic dispersants, metallic detergents, non-metallic detergents, corrosion inhibitors, rust inhibitors, metal deactivators, metallic anti-wear agents, non-metallic anti-wear agents, phosphorus-containing anti-wear agents, non-phosphorus containing anti-wear agents, sulfur-containing anti-wear agents, non-sulfur containing anti-wear agents, metallic extreme pressure additives, non-metallic extreme pressure additives, phosphorus-containing extreme pressure additives, non-phosphorus containing extreme pressure additives, sulfur-containing extreme pressure additives, non-sulfur containing extreme pressure additives, anti-seizure agents, pour point depressants, wax modifiers, viscosity modifiers, seal compatibility agents, friction modifiers, lubricity agents, anti-staining agents, chromophoric agents, defoamants, demulsifiers, and a combination thereof. The lubricating fluid further comprises at least one lubricant base oil selected from a group consisting of: mineral oil, polyalphaolefin, ester, polyalkylene glycol, ethylene-propylene oil, silicone oil, and a combination thereof.

Other features and aspects of the present teachings will become apparent from the following detailed description, taken in conjunction with the accompanying drawings, which illustrate by way of example the features in accordance with embodiments of the present teachings. The summary is not intended to limit the scope of the present teachings, which is defined by the claims included herein.

DETAILED DESCRIPTION

Figure 1:
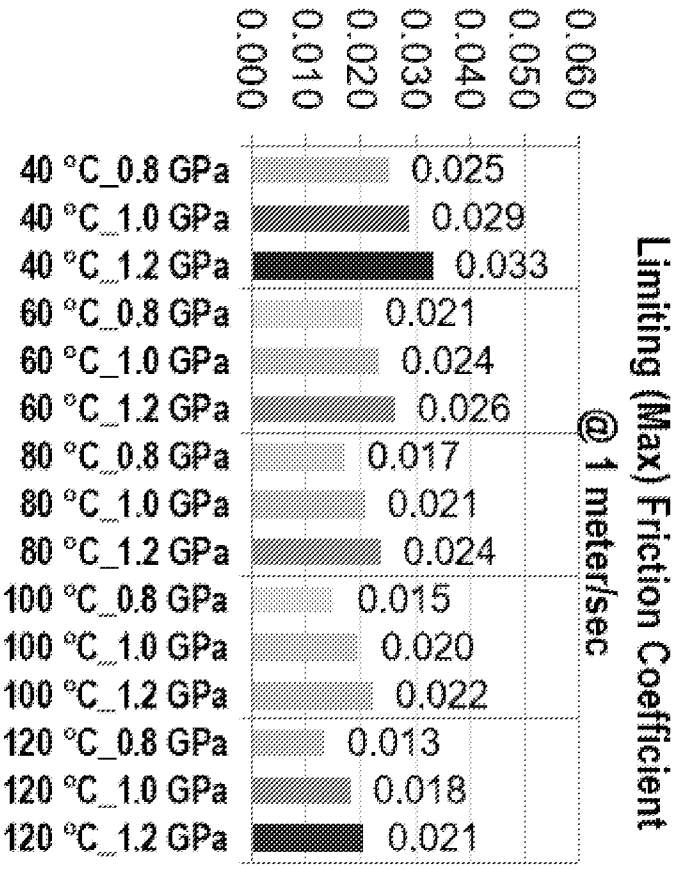
FIGS. 1-2 illustrate the shear strength of a single branched carboxyl di-ester according to one embodiment.

The present teachings are described more fully hereinafter with reference to the accompanying drawings, in which the present embodiments are shown. The following description illustrates the present teachings by way of example, not by way of limitation of the principles of the present teachings.

The present teachings have been described in language more or less specific as to structural features. It is to be understood, however, that the present teachings are not limited to the specific features shown and described, since the product and/or method herein disclosed comprises preferred forms of putting the present teachings into effect.

Generally, all terms used in the claims are to be interpreted according to their ordinary meaning in the technical field, unless explicitly defined otherwise herein. All references to a/an/the element, apparatus, component, means, step, etc. are to be interpreted openly as referring to at least one instance of the element, apparatus, component, means, step, etc., unless explicitly stated otherwise. Other than in the operating examples, or where otherwise indicated, all numbers expressing quantities of ingredients or reaction conditions used herein are to be understood as modified in all instances by the term "about".

The present teachings provide base oils for formulated lubricants of ultra-low viscosity, high flash point, high viscosity index (VI), low elastohydrodynamic shear strength, and good low-temperature performance to produce lubricating fluids of high energy efficiency and improved temperature properties that are adapted for elastohydrodynamic lubrication.

Base Oils

The present teachings utilize carboxylic esters of carboxyl di-end-capped-polyethylene glycols, or a mixture thereof, to have ultra-low viscosity, high flash point, high viscosity index (VI), excellent low-temperature properties (viscosity and pour/freeze points), and low elastohydrodynamic (EHD) shear strength, and to enable the production of high efficiency fluids with enhanced temperature properties for machines or machine elements that operate in the elastohydrodynamic regime of lubrication.

The present teachings provide a lubricating base oil comprising a carboxyl di-ester of polyethylene glycol. In one embodiment, the carboxyl di-ester of polyethylene glycol has the structure of formula (1):

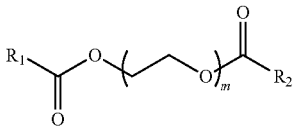

R1 and R2 may each independently comprise linear alkyl groups each having 4 to 6 carbon atoms. Further, in other examples, R1 and R2 each may contain branched alkyl groups having 4 to 6 carbon atoms, wherein the amount of branched alkyl groups in the combination of R1 and R2 is less than 10 wt. %, less than 5 wt. %, or less than 1 wt. % of the total weight of carboxyl di-ester of polyethylene glycol.

In some examples, R1 and R2 each may be independently derived from a mixture of butyric carboxylic acid, pentanoic carboxylic acid, and hexanoic carboxylic acid. In some examples, R1 and R2 are each independently derived from butyric carboxylic acid. In some examples, R1 and R2 are each independently derived from pentanoic carboxylic acid. In some examples, R1 and R2 are each independently derived from hexanoic carboxylic acid.

(CH2-CH2-O) refers to an ethylene oxide unit (EO unit). In some embodiments of formula (1), m ranges from 2 to 12, preferably from 2 to 7.

The carboxyl di-ester of polyethylene glycol of formula (1) has an average molecular weight ranging from 240 g/mole to 500 g/mole. Base oils comprised of low molecular weight carboxyl diesters of polyethylene oxide can provide lubricating fluids that have ultra-low viscosity, high flash points, high VI, low EHD shear strength, and low freeze points (or pour points).

The lubricating fluid comprising the carboxyl di-ester of polyethylene glycol of formula (1) has low viscosity, such as ultra-low kinematic viscosity (e.g., ≤3.8 cSt at 100° C.).

The lubricating fluids containing the carboxyl di-ester of polyethylene glycol of formula (1) also possess high flash points (e.g., ≥200° C.).

The lubricating fluids containing the carboxyl di-ester of polyethylene glycol of formula (1) also possess high VI (e.g., ≥150).

The lubricating fluids containing the carboxyl di-ester of polyethylene glycol of formula (1) possess extremely low shear strength in elastohydrodynamic sliding and rolling-sliding contacts and will therefore enable fluids used in elastohydrodynamic lubrication to be produced that have high energy efficiency from low shearing losses.

The lubricating fluids containing the carboxyl di-ester of polyethylene glycol of formula (1) also possess extremely low freeze point that improves the low temperature performance of the lubricating fluids, which can be used in all applications where machine elements may operate in low temperature environments (e.g., automotive, wind turbines, alternative energy). In one embodiment, the lubricating fluid comprising the carboxyl di-ester of polyethylene glycol of formula (1) has a freeze point≤−25° C.

Characterizations of Base Oils with or without Additives

The lubricating fluids of the present teachings may be characterized by a variety of standard tests known to one of ordinary skill in the art. The energy efficiency of the lubricating fluids may be affected by the viscosity of the lubricating fluids and the traction coefficient of the lubricating fluids. The viscosity of the lubricating fluids is closely related to its ability to reduce friction in the contacts between solid surfaces. The traction coefficient of the lubricating fluids is related to the energy losses with a certain load.

Traction coefficients may be measured using PCS Mini-Traction Machine (MTM) from PCS Instruments, Ltd. measured at various slide-to-roll ratios (e.g., 0.1% to 200%), temperatures, and loads ranging from 20N to 70N or a maximum Hertzian contact stress of 0.5 GPa to 1.5 GPa.

Viscosity, often referred to as Dynamic Viscosity (DV), can be measured using Kinematic Viscosity (KV). Kinematic Viscosity (KV) may be determined by ASTM D445-06 Standard Test Method for Kinematic Viscosity of Transparent and Opaque Liquids (and Calculation of Dynamic Viscosity). Kinematic Viscosity may also be calculated from a measurement of Dynamic Viscosity (DV) at low shear rates and density using the equation: $KV=DV/\rho$, where $\rho$ is density.

Viscosity Index (VI) is a unitless measurement of a lubricating fluid's change in viscosity relative to temperature change. The higher the VI, the more stable the viscosity remains over temperature fluctuations. Viscosity Index may be determined by ASTM D2270-04 Standard Practice for Calculating Viscosity Index from Kinematic Viscosity at 40° C. and 100° C.

Flash point is the lowest temperature at which a lubricating fluid's vapors ignite when an ignition source is applied. The flash point may be determined by various methods and standards (see e.g., CEN/TR 15138 Guide to Flash Point Testing and ISO TR 29662 Guidance for Flash Point Testing), and the measured value may vary with different equipment and test protocols, including temperature ramp rate, time allowed for the sample to equilibrate, sample volume, sample stirring, etc. Two basic measuring methods of the flash point are open cup and closed cup. In open cup devices, the sample is contained in an open cup and an ignition source is brought. In closed cup devices, the sample is contained in a cup sealed with a lid and an ignition source can be introduced.

The following Table 1 illustrates some examples of the lubricating fluids of the present teachings in the measurement of DV, KV, VI, flash point, and freeze point (or pour point).

TABLE 1

Examples of low molecular weight carboxyl diesters of polyethylene oxides.

| Composition | Average Molecular Weight (g/mol) | DV at 0° C. (cP) | DV at −10° C. (cP) | DV at −20° C. (cP) | DV at −30° C. (cP) | KV at 40° C. (cSt) | KV at 100° C. (cSt) | VI | Flash Point, Closed Cup (° C.) | Freeze Point (° C.) |
|---|---|---|---|---|---|---|---|---|---|---|
| DEG with Hexanoic (n-C6) Acid and 2 EO units | 302 | 28.5 | 54.7 | 122.1 | N/A (solid) | 4.8 | 1.7 | N/A | 210 | −26 |
| TTEG with Hexanoic (n-C6) Acid and 4 EO units | 391 | 51.3 | 100.9 | 207.6 | N/A (solid) | 8.41 | 2.60 | 155 | 225 | −32 |
| PEG 200 with Hexanoic (n-C6) Acid and 4.1 EO units | 396 | 49.4 | 99.3 | 211.9 | 411.6 | 8.78 | 2.79 | 183 | 223 | <−40 |
| PEG 200 with Butyric (n-C4) Acid and 4.1 EO units | 340 | 36.8 | 72.4 | 153.2 | 293.5 | 6.12 | 2.15 | 184 | 217 | <−40 |
| PEG 300 with Hexanoic (n-C6) Acid and 6.4 EO units | 496 | 80.9 | 154.0 | 335.9 | 638.1 | 13.61 | 3.79 | 185 | 240 | −38 |
| PEG 300 with Butyric (n-C4) Acid and 6.4 EO units | 440 | 61.1 | 118.5 | 249.8 | 480.2 | 9.06 | 2.87 | 187 | 233 | <−40 |

Note:
DEG refers to Diethylene Glycol, which is polyethylene glycol with 2 EO units.
TTEG refers to Tetraethylene Glycol, which is polyethylene glycol with 4 EO units.
PEG 200 refers to polyethylene glycol of nominal average molecular weight of 200 Daltons.
PEG 300 refers to polyethylene glycol of nominal average molecular weight of 300 Daltons.
To calculate VI, KV at 100° C. must be no less than 2.0 cSt.

Note: DEG refers to Diethylene Glycol, which is polyethylene glycol with 2 EO units. TTEG refers to Tetraethylene Glycol, which is polyethylene glycol with 4 EO units. PEG 200 refers to polyethylene glycol of nominal average molecular weight of 200 Daltons. PEG 300 refers to polyethylene glycol of nominal average molecular weight of 300 Daltons. To calculate VI, KV at 100° C. must be no less than 2.0 cSt.

The following Table 2 illustrates some examples of simple diesters of PEG 300 with normal and single-branched carboxylic acids in the measurement of KV, VI, Density, DV, freeze point (or pour point), and flash point (or Cleveland CC flash point). A first sample "1" refers to iso-valeryl PEG 300 diester (alpha-methyl branch). A second sample "2" refers to 2-ethylhexyl PEG 300 diester (alpha-ethyl branch). A third sample "3" refers to n-hexyl PEG 300 diester (linear, no branching).

TABLE 2

Comparison of Simple Diesters of PEG 300 with Normal & Single-Branched Carboxylic Acids

| | 1 | 2 | 3 |
|---|---|---|---|
| KV 40 C., cSt | 15.02 | 17.15 | 13.62 |
| KV100 C., cSt | 4.05 | 4.33 | 3.79 |
| VI | 178 | 169 | 185 |
| Density 20 C., g/mL | 1.0227 | 1.0192 | 1.0309 |
| DV 0 C., cP | 94 | 108 | 81 |
| DV −10 C., cP | 202 | 257 | 154 |
| DV −20 C., cP | 442 | 584 | 336 |
| DV −30 C., cP | 897 | frozen | 638 |
| Freeze Pt, C. | −31 | −24 | −38 |
| Cleveland CC Flash, C. | 224 | 228 | 240 |

As shown by the results in Table 2, sample 3, the linear n-hexyl PEG fluid, exhibited a lower KV, a higher VI, an improved lower temperature viscosity, a lower freeze point, and a higher flash point, even with a lower viscosity, as compared to the single branched samples (i.e., sample 1 and sample 2).

It may be expected that some above property differences between the branched and linear samples can be attributed to the structure-property relationships in lubricated base oils. However, the lower freeze point of the linear PEG diester is an unexpected result because typically branching generally reduces the freeze or pour point in lubricated base oils. Additionally, the higher flash point of the linear PEG diester is an unexpected result because all three samples have a similar molecular weight. As such, the lack of branching in sample 3 appears to contribute to the unexpected relatively high flash point.

Figure 2:
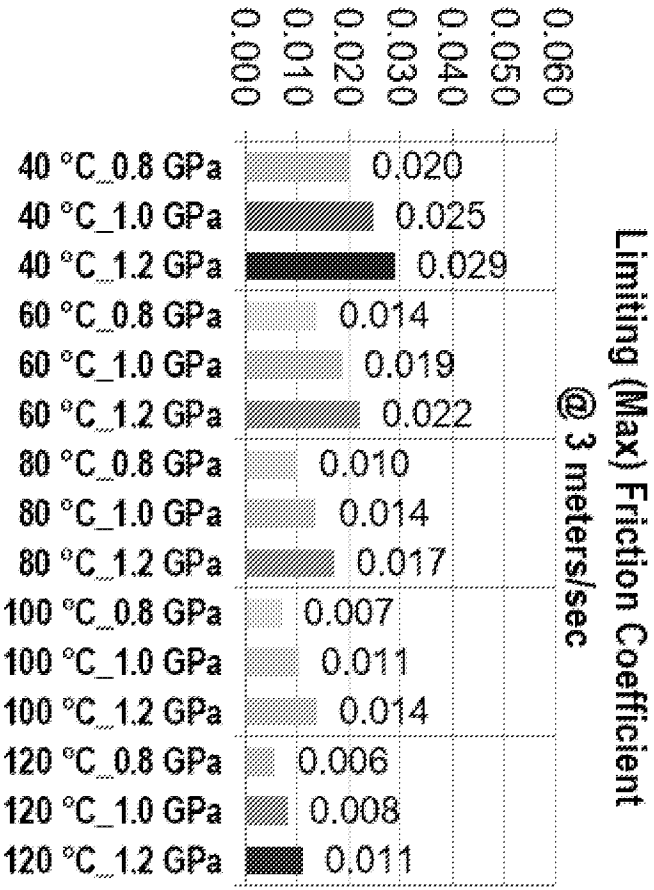
Figure 3:
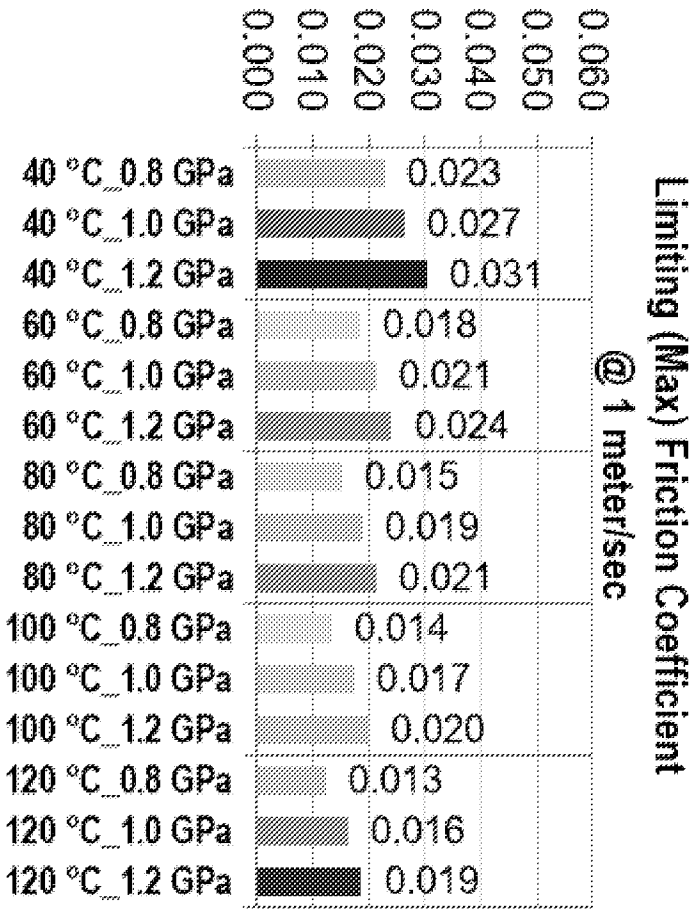
FIGS. 3-4 illustrate the shear strength of a single branched carboxyl di-ester according to another embodiment.
Figure 4:
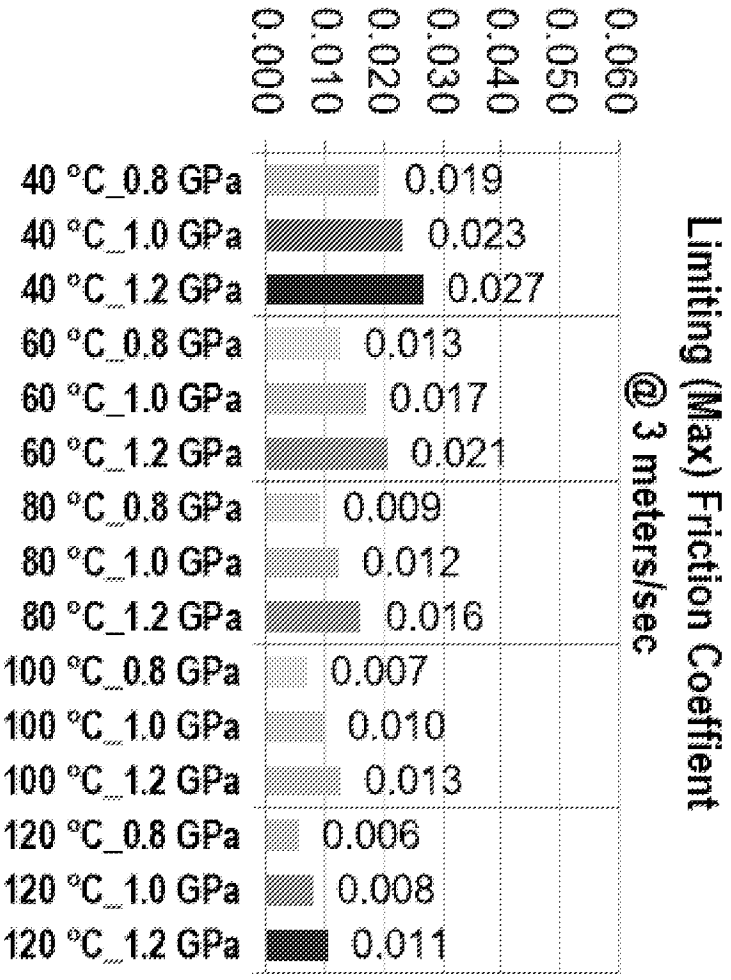
Figure 5:
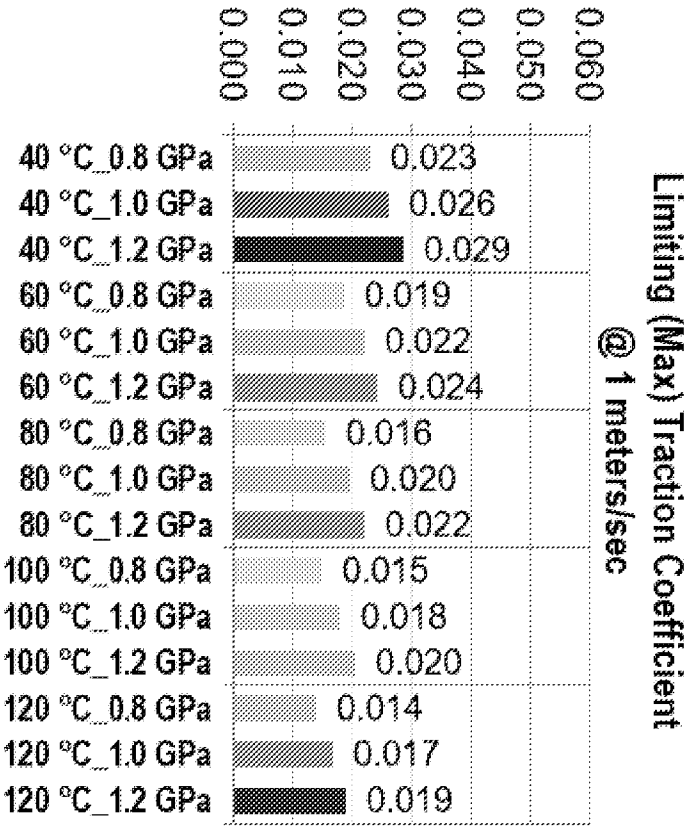
FIGS. 5-6 illustrate the shear strength of a linear carboxyl di-ester according to an embodiment.
Figure 6:
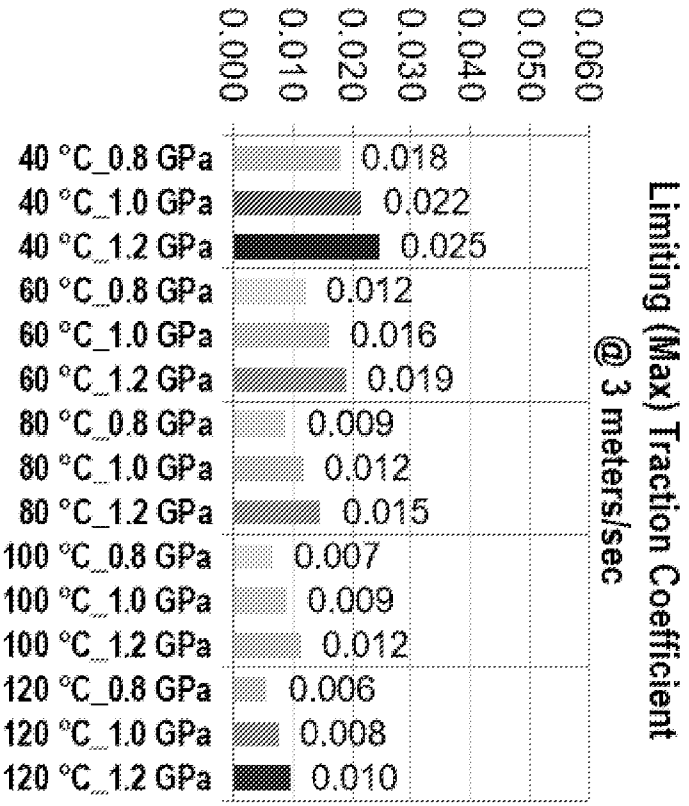

Referring to FIGS. 1-6 the shear strength of each of the three samples at various temperatures, pressures, and shear rates are shown. FIGS. 1 and 2 illustrate the maximum traction coefficient of Sample 1 at various temperatures and pressures when a shear rate of 1 m/s (meter per second) and 3 m/s are applied, respectively. FIGS. 3 and 4 illustrate the maximum traction coefficient of Sample 2 at various temperatures and pressures when a shear rate of 1 m/s (meter per second) and 3 m/s are applied, respectively. FIGS. 5 and 6 illustrate the maximum traction coefficient of Sample 3 at various temperatures and pressures when a shear rate of 1 m/s (meter per second) and 3 m/s are applied, respectively. Each of the above test were performed at temperatures between 40° C. and 120° C. and pressures between 0.8 GPa (giga pascals) and 1.2 GPa.

As can be seen, the elastohydrodynamic (EHD) shear strength of the linear diesters (i.e., FIGS. 5 and 6 corresponding to Sample 3) is similar to the EHD shear strength of the branched diesters (i.e., FIGS. 1 and 2 corresponding to Sample 1, and FIGS. 3 and 4 corresponding to Sample 2). Although, the linear diesters show a slightly lower EHD shear strength compared to the branched diesters, the linear diesters show an overall improved performance compared to the branched diesters as illustrated in Table 2 above. Thus, the linear diesters can provide a similar EHD shear strength while providing advantages such as improved performance in colder conditions. This may be due to the fact that the long string of enchained ethylene oxides, a component of PEG, in the backbone of the molecules makes up a large portion of the molecular structure. Therefore, the long string of enchained ethylene oxides may govern many properties of the samples, including the EHD shear strength.

The various embodiments of lubricating fluids according to the present teachings may further comprise at least one additive that in some embodiments may be selected from the group consisting of: dispersant, detergent, defoamer, antioxidant, rust inhibitor, friction modifier, corrosion inhibitor, extreme pressure additive, anti-wear additive, pour point depressant, and combinations thereof.

Examples of the dispersant, including ashless dispersant, according to the present teachings may include one or more of those based on polybutenyl succinic acid imide, polybutenyl succinic acid amide, benzylamine, succinic acid ester, succinic acid ester-amide, or a boron derivative thereof. The ashless dispersant may be incorporated normally at 0.05 wt. % to 7 wt. % of the total weight of the lubricating fluid.

Examples of the detergent, including metallic detergent, according to the present teachings may include one or more of those containing a sulfonate, phenate, salicylate, and phosphate of calcium, phosphate of magnesium, phosphate of barium, or the like. It may be optionally selected from perbasic, basic, neutral salts, and so forth of different acid value. The metallic detergent is optionally incorporated at 0.05 wt. % to 5 wt. % of the total weight of the lubricating fluid.

Examples of the defoamer according to the present teachings may include one or more of polydimethylsilicone, trifluoropropylmethylsilicone, colloidal silica, a polyalkyl acrylate, a polyalkylmethacrylate, an alcohol ethoxy/propoxylate, a fatty acid ethoxy/propoxylate, and a sorbitan partial fatty acid ester. The defoamer may be incorporated normally at 10 to 100 mg/l.

Examples of the antioxidant according to the present teachings may include one or more of amine-based antioxidants, e.g., alkylated diphenylamine, phenyl-α-naphtylamine and alkylated phenyl-x-naphtylamine; phenol-based ones, e.g., 2,6-di-t-butyl phenol, 4,4'-methylenebis-(2,6-di-t-butyl phenol) and isooctyl-3-(3,5-di-t-butyl-4-hydroxyphenyl)propionate; and/or sulfur-based antioxidants, e.g., dilauryl-3,3'-thiodipropionate; and zinc dithiophosphate. The antioxidant may be incorporated normally at 0.05 wt. % to 5 wt. % of the total weight of the lubricating fluid.

Examples of the rust inhibitor according to the present teachings may include one or more of a fatty acid, alkenylsuccinic acid half ester, fatty acid soap, alkylsulfonate, polyhydric alcohol/fatty acid ester, fatty acid amine, oxidized paraffin, and alkylpolyoxyethylene ether. The rust inhibitor may be incorporated normally at 0 wt. % to 37 wt. % of the total weight of the lubricating fluid.

Examples of the friction modifier according to the present teachings may include one or more of an organomolybdenum-based compound, higher alcohols such as oleyl alcohol and stearyl alcohol; fatty acids such as oleic acid and stearic acid; esters such as oleyl glycerin ester, steryl glycerin ester, and lauryl glycerin ester; amides such as lauryl amide, oleyl amide, and stearyl amide; amines such as laurylamine, oleylamine, stearylamine, and an alkyldiethanolamine; and ethers such as lauryl glycerin ether and oleyl glycerin ether, oil/fat, amine, sulfided ester, phosphoric acid ester, acid phosphoric acid ester, acid phosphorous acid ester and amine salt of phosphoric acid ester. The friction modifier may be incorporated normally at 0.05 wt. %. to 5 wt. % of the total weight of the lubricating fluid.

Examples of the extreme pressure additive according to the present teachings may include one or more of organic sulfur, phosphorus or chlorine compounds, including sulfur-phosphorus and sulfur-phosphorus-boron compounds, which chemically react with the metal surface under high pressure conditions.

Examples of the anti-wear additive according to the present teachings may include one or more of zinc dithiophosphate, zinc dialkyl dithio phosphate, tricresyl phosphate, halocarbons (chlorinated paraffins), glycerol mono oleate, and stearic acid.

Examples of the corrosion inhibitor according to the present teachings may include zinc dithiophosphates.

Examples of the pour point depressant according to the present teachings may include one or more of ethylene/vinyl acetate copolymer, condensate of chlorinated paraffin and naphthalene, condensate of chlorinated paraffin and phenol, polymethacrylate, polyalkyl styrene, and so forth. The pour point depressant may be incorporated normally at 0.1 wt. % to 10 wt. % of the total weight of the lubricating fluid.

In addition, solubilizing agent (i.e., co-solvents) that are used to dissolve polar additives in usually less polar or non-polar base oils may be included according to the present teachings.

A total content of additive(s) in the lubricating fluid composition of the present teachings is not limited. However, one or more additives (including the above-described solubilizing agent) may be incorporated at 1 wt. % to 30 wt. % of the total weight of the lubricating fluid, preferably 2 wt. % to 15 wt. % of the total weight of the lubricating fluid.

Figure 7:
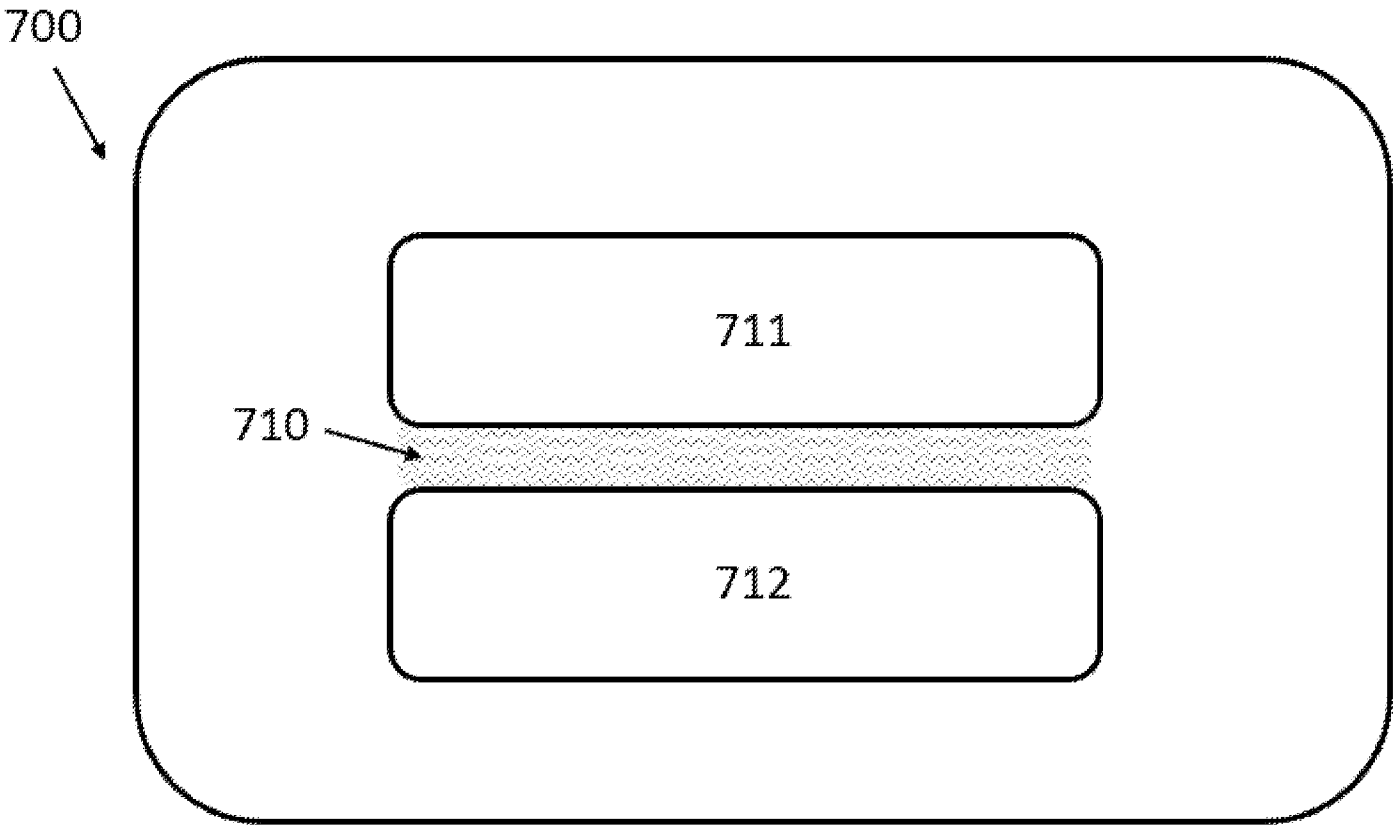
FIG. 7 illustrates a manner of using the lubricating fluid according to the present teachings.

Referring to FIG. 7, the lubricating fluid 70 according to the present teachings is applied and used between two mechanical parts 711, 712 of a machine 700, for example a motor or engine. The lubricating fluid 710 has improved temperature performance, as well as high energy efficiency, and enables the mechanical parts 711, 712 to operate in the elastohydrodynamic regime in lubrication. Thus, the present teachings provide a machine which comprises two parts and the lubricating fluid applied between the two parts. The present teachings also provide a process of using the lubricating fluid which includes applying the lubricating fluid between two parts of a machine.

The lubricating fluid according to the present teachings may comprise at least one additive selected from a group consisting of: oxidation inhibitors, metallic dispersants, non-metallic dispersants, metallic detergents, non-metallic detergents, corrosion inhibitors, rust inhibitors, metal deactivators, metallic anti-wear agents, non-metallic anti-wear agents, phosphorus-containing anti-wear agents, non-phosphorus containing anti-wear agents, sulfur-containing anti-wear agents, non-sulfur containing anti-wear agents, metallic extreme pressure additives, non-metallic extreme pressure additives, phosphorus-containing extreme pressure additives, non-phosphorus containing extreme pressure additives, sulfur-containing extreme pressure additives, non-sulfur containing extreme pressure additives, anti-seizure agents, pour point depressants, wax modifiers, viscosity modifiers, seal compatibility agents, friction modifiers, lubricity agents, anti-staining agents, chromophoric agents, defoamants, demulsifiers, and a combination thereof.

The lubricating fluid according to the present teachings may further contain one or more other lubricant base oils, and at least one of said other lubricant base oils is selected from a group consisting of mineral oil (i.e., Group I, II, II+, III, III+), polyalphaolefin (PAO) (Group IV), ester (Group V), polyalkylene glycol (PAG), ethylene-propylene oil, silicone oil and any other lubricating base oil used in lubricant and grease compounding.

While the present teachings have been described above in terms of specific embodiments, it is to be understood that they are not limited to those disclosed embodiments. Many modifications and other embodiments will come to mind to those skilled in the art to which this pertains, and which are intended to be and are covered by both this disclosure and the appended claims. For example, in some instances, one or more features disclosed in connection with one embodiment can be used alone or in combination with one or more features of one or more other embodiments. It is intended that the scope of the present teachings should be determined by proper interpretation and construction of any claims and their legal equivalents, as understood by those of skill in the art relying upon the disclosure in this specification and the attached drawings.

The invention claimed is:

1. A lubricating fluid comprising:

a carboxyl di-ester of polyethylene glycol having a formula (1)

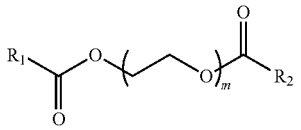

wherein $R_1$ and $R_2$ each independently comprise branched alkyl groups, each alkyl group having 4 to 6 carbon atoms, and wherein m ranges from 2 to 12, and wherein the carboxyl di-ester of polyethylene glycol has an average molecular weight ranging from 240 g/mol to 500 g/mol, wherein the lubricating fluid has a freeze point of at most −40° C.

2. The lubricating fluid of claim 1, wherein $R_1$ and $R_2$ each comprise an alpha-methyl group.

3. The lubricating fluid of claim 1, wherein $R_1$ and $R_2$ each comprise an alpha-ethyl group.

4. The lubricating fluid of claim 1, wherein the lubricating fluid has a Flash Point measured in a closed cup of at least 200° C.

5. The lubricating fluid of claim 1, wherein the lubricating fluid has a Kinematic Viscosity of at most 3.8 cSt at 100° C.

6. The lubricating fluid of claim 1, wherein the lubricating fluid has a Viscosity Index of at least 150.

7. The lubricating fluid of claim 1, further comprising at least one additive selected from the group consisting of: oxidation inhibitors, metallic dispersants, non-metallic dispersants, metallic detergents, non-metallic detergents, corrosion inhibitors, rust inhibitors, metal deactivators, metallic anti-wear agents, non-metallic anti-wear agents, phosphorus-containing anti-wear agents, non-phosphorus containing anti-wear agents, sulfur-containing anti-wear agents, non-sulfur containing anti-wear agents, metallic extreme pressure additives, non-metallic extreme pressure additives, phosphorus-containing extreme pressure additives, non-phosphorus containing extreme pressure additives, sulfur-containing extreme pressure additives, non-sulfur containing extreme pressure additives, anti-seizure agents, pour point depressants, wax modifiers, viscosity modifiers, seal compatibility agents, friction modifiers, lubricity agents, anti-staining agents, chromophoric agents, defoamants, demulsifiers, and a combination thereof.

8. The lubricating fluid of claim 1, further comprising at least one lubricant base oil selected from a group consisting of: mineral oil, polyalphaolefin, ester, polyalkylene glycol, ethylene-propylene oil, silicone oil, and a combination thereof.

9. The lubricating fluid of claim 1, wherein the lubricating fluid has a maximum traction coefficient of less than 0.02 at a shear rate of 1 m/s.

10. The lubricating fluid of claim 1, wherein the lubricating fluid has a maximum traction coefficient of less than 0.02 at a shear rate of 3 m/s.

11. A machine comprising:

at least one machine element comprising a first and a second mechanical part, wherein at least one surface of the first mechanical part is in mutual contact and non-conforming with at least one surface of the second mechanical part; and a lubricating fluid applied between the non-conforming surfaces of the first and second mechanical parts and operable to enable the mechanical parts to operate in an elastohydrodynamic lubrication regime, the lubricating fluid comprising:

a carboxyl di-ester of polyethylene glycol having a formula (1)

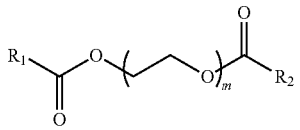

wherein $R_1$ and $R_2$ each independently comprise alkyl groups, each alkyl group having 4 to 6 carbon atoms, and wherein m ranges from 2 to 12, wherein the carboxyl di-ester of polyethylene glycol has an average molecular weight ranging from 240 g/mol to 500 g/mol.

12. The machine of claim 11, wherein the lubricating fluid has a maximum traction coefficient of less than 0.02 at a shear rate of 1 m/s.

13. The machine of claim 11, wherein the lubricating fluid has a maximum traction coefficient of less than 0.02 at a shear rate of 3 m/s.

14. The machine of claim 11, wherein the first and the second mechanical part are gears.

15. The machine of claim 11, wherein the lubricating fluid has a freeze point of at most −24° C.

16. A process of lubricating at least one elastohydrodynamic machine element in an electric vehicle transmission, the at least one elastohydrodynamic machine element having two mechanical parts, the process comprising the steps of:

providing a lubricating fluid comprising:

a carboxyl di-ester of polyethylene glycol having a formula (1)

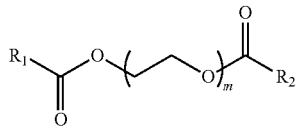

wherein $R_1$ and $R_2$ each independently comprise alkyl groups, each alkyl group having 4 to 6 carbon atoms, and wherein m ranges from 2 to 12, wherein the carboxyl di-ester of polyethylene glycol has an average molecular weight ranging from 240 g/mol to 500 g/mol; and applying the lubricating fluid between non-conforming surfaces of the two mechanical parts and operable to enable the mechanical parts to operate in an elastohydrodynamic lubrication regime.

17. The process of claim 16, wherein the lubricating fluid has a maximum traction coefficient of less than 0.02 at a shear rate of 1 m/s.

18. The process of claim 16, wherein the lubricating fluid has a maximum traction coefficient of less than 0.02 at a shear rate of 3 m/s.

19. The process of claim 16, wherein the lubricating fluid has a freeze point of at most −24° C.

20. The process of claim 16, wherein the lubricating fluid has a freeze point of at most −40° C.

* * * * *